US007045723B1

(12) United States Patent
Projkovski

(10) Patent No.: US 7,045,723 B1
(45) Date of Patent: May 16, 2006

(54) FAIL SAFE ELECTRICAL RECEPTACLE

(76) Inventor: Joti Projkovski, 940 Woodshire La., Apartment M10, Naples, FL (US) 34105

( * ) Notice: Subject to any disclaimer, the term of this patent is extended or adjusted under 35 U.S.C. 154(b) by 0 days.

(21) Appl. No.: 11/235,811

(22) Filed: Sep. 27, 2005

(51) Int. Cl.
*H01R 33/96* (2006.01)

(52) U.S. Cl. ..... 200/51.09; 200/51.11; 439/188

(58) Field of Classification Search ..... 200/51, 200/51.09, 51.1, 51.11, 51.12, 334; 174/66, 174/67; 439/188, 63, 83, 489, 744, 931, 439/944, 733.1
See application file for complete search history.

(56) References Cited

U.S. PATENT DOCUMENTS

| | | | | |
|---|---|---|---|---|
| 3,846,598 | A | 11/1974 | Mucsi | |
| 4,168,104 | A | 9/1979 | Buschow | |
| 4,271,337 | A | 6/1981 | Barkas | |
| 4,591,732 | A | 5/1986 | Neuenschwander | |
| 4,867,694 | A | 9/1989 | Short | |
| 4,995,017 | A | 2/1991 | Sellati et al. | |
| 5,095,182 | A * | 3/1992 | Thompson | 200/51.09 |
| 5,113,045 | A | 5/1992 | Crofton | |
| 5,267,870 | A | 12/1993 | Maresh | |
| 5,387,761 | A | 2/1995 | Simonis | |
| 6,111,210 | A * | 8/2000 | Allison | 200/51.09 |
| 6,310,306 | B1 * | 10/2001 | Norling | 200/51.09 |
| 6,455,789 | B1 * | 9/2002 | Allison | 200/51.09 |
| 6,678,131 | B1 * | 1/2004 | Chapman et al. | 200/51.09 |
| 2002/0104745 | A1 | 8/2002 | Allison | |
| 2003/0045145 | A1 | 3/2003 | Mortun et al. | |
| 2003/0085108 | A1 | 5/2003 | Chiang et al. | |
| 2003/0124893 | A1 | 7/2003 | Campbell | |
| 2004/0067692 | A1 | 4/2004 | Chevarie et al. | |

* cited by examiner

*Primary Examiner*—Michael A. Friedhofer
(74) *Attorney, Agent, or Firm*—Edward M. Livingston; Angela Marie Miller; The Livingston Firm

(57) ABSTRACT

A fail safe electrical receptacle (1) having normally open switches (6) and normally closed switches (7). The normally open switches (6) are wired to a breaker (11) and are located above the slots (2) and (3) while the normally closed position switches (7) are located below the slots (2) and (3). The contact arms (18) wired to the neutral slot (2) are neutral while the contact arms (10) wired to the hot slot (3) are grounded. If the switch levers (9) and (8) located behind the slots (2) and (3) are pressed against the normally closed switches (7), a circuit is not completed and therefore no power is provided to the outlet. However, if the switch levers (9) or (8) are pressed against the normally open switches (6), the circuit between the hot (3) and the ground (17) or the ground (17) and the hot slot (3) is completed and the breaker (11) is tripped.

10 Claims, 2 Drawing Sheets

FAIL SAFE ELECTRICAL RECEPTACLE

BACKGROUND OF THE INVENTION

This invention relates to fail safe electrical receptacles, more particularly, a fail safe electrical receptacle that provides power to an outlet only when a standard electrical plug is inserted into the outlet and trips a breaker when an object which is not a standard electrical plug is inserted into an outlet.

Oftentimes, accidents occur in the home due to children inserting objects into power receptacles. If the child is lucky, he or she receives only a minor shock and learns to never insert anything other than an electrical plug into a power receptacle. However, more often than not, a child receives a severe shock, which may not only cause physical and psychological damage to the child, but may also cause physical damage to the home.

In order to help reduce the amount of these types of accidents in the home, a wide range of receptacle safety devices have been invented and used. For instance, the most common method of child safety proofing a receptacle is by inserting plastic safety plugs into an unused outlet. Although the outlet covers do provide protection, oftentimes the adults forget to reinsert the covers after using the outlet, thereby exposing the live outlet to the children.

In addition, a wide variety of shock resistant electrical outlets have been invented wherein power is not provided to the outlet unless the internal switches are triggered, via electrical plugs or other object, to an on position. In many instances, however, children become creative and insert two different foreign objects into the receptacle at once, thereby turning on both internal switches to complete a circuitry loop, resulting in the child getting shocked.

What may be one of the worst aspects of children inserting foreign objects into a receptacle and receiving a shock is that oftentimes the parent and/or adult in charge of watching the child does not know the child received a shock as children typically experiment with the receptacles out of the adult's supervision. Thus, a child may be seriously injured in one room due to the shock while the adult is in another room going about his/her business, oblivious to what had just transpired. If the child was fortunate and did not receive a shock, he or she may be tempted to insert foreign objects into other outlets, unknowing that doing so may electrocute himself/herself.

Thus, there exists the need for a receptacle which provides power to only when a standard electrical plug is inserted into the outlet and further provides a means to inform a person that someone inserted a foreign object into a receptacle.

The relevant prior art includes the following patents:

| Patent No. (U.S. unless stated otherwise) | Inventor | Issue/Publication Date |
|---|---|---|
| 2003/0124893 | Campbell | Jul. 3, 2003 |
| 2002/0104745 | Allison | Aug. 8, 2002 |
| 6,455,789 | Allison | Sep. 24, 2002 |
| 4,271,337 | Barkas | Jun. 2, 1981 |
| 6,111,210 | Allison | Aug. 29, 2000 |
| 4,995,017 | Sellati et al. | Feb. 19, 1991 |
| 5,113,045 | Crofton | May 12, 1992 |
| 4,951,732 | Neuenschwander | May 27, 1986 |
| 2004/0067692 | Chevarie et al. | Apr. 8, 2004 |
| 3,846,598 | Mucsi | Nov. 5, 1974 |
| 2003/0085108 | Chiang et al. | May 8, 2003 |
| 2003/0045145 | Mortun et al. | Mar. 6, 2003 |

-continued

| Patent No. (U.S. unless stated otherwise) | Inventor | Issue/Publication Date |
|---|---|---|
| 5,267,870 | Maresh | Dec. 7, 1993 |
| 4,867,694 | Short | Sep. 19, 1989 |
| 4,168,104 | Buschow | Sep. 18, 1979 |
| 5,387,761 | Simonis | Feb. 7, 1995 |

Although the prior art discloses many safety electrical receptacles, non has the same structure and operation as the present invention.

SUMMARY OF THE INVENTION

The primary object of the present invention is to provide a fail safe electrical receptacle that provides power to an outlet only when a standard electrical plug is inserted into the outlet.

A further object of the present invention is to provide a fail safe electrical receptacle that trips a breaker when a foreign object is inserted into a receptacle.

An even further object of the present invention is to provide a fail safe electrical receptacle that promotes child safety.

A further object of the present invention is to provide a fail safe electrical receptacle that alerts adults when a person has inserted a foreign object into a receptacle.

An even further object of the present invention is to provide a fail safe electrical receptacle that is cost efficient to manufacture.

An even further object of the present invention is to provide a fail safe electrical receptacle that is simple to manufacture.

An additional object of the present invention is to provide a fail safe electrical receptacle for use on temporary power poles for improving safety on construction sites.

The present invention fulfills the above and other objects by providing a fail safe electrical receptacle comprised of a receptacle having at least one outlet, the outlet having a neutral slot, a hot slot and a ground slot, two normally open switches and two normally closed switches and contact arms and switch levers located on both the neutral side and hot side of the outlet.

The normally open switches, which are wired to the breaker, are located above the slots while the normally closed position switches are located below the slots. The contact arms wired to the neutral slot are neutral while the contact arms wired to the hot slot are grounded. When both prongs of a standard electrical plug are inserted into the outlet, the prongs make contact with all four contact arms, thus providing power to the electrical device. However, when an object is inserted into either of the slots, the object first makes contact with the switch levers. If the switch levers are pressed against the normally closed switches, a circuit is not completed and therefore no power is provided to the outlet. However, if the switch levers are pressed against the normally open switches, the circuit between the hot and the ground or the ground and the neutral slot is completed and the breaker is tripped. Finally, if a foreign object, such as tweezers, is inserted into both slots at the same time, the breaker will trip because a direct connection between both the neutral and grounded contact arms has been made before the switches are reached.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
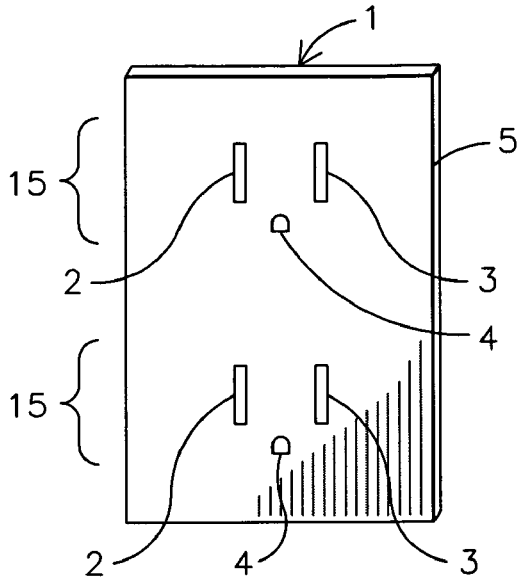
FIG. 1 is a front perspective view of the present invention.

For purposes of describing the preferred embodiment, the terminology used in reference to the numbered components in the drawings is as follows:

1. fail safe electrical receptacle, generally
2. neutral slot
3. hot slot
4. ground slot
5. receptacle cover
6. normally open switch
7. normally closed switch
8. hot side switch lever
9. neutral side switch lever
10. hot side contact arm
11. breaker
12. neutral wiring
13. hot wiring
14. grounded wiring
15. outlet
16. activator
17. ground
18. neutral side contact arm With reference to FIG. 1, a front perspective view of the present invention is shown. The fail safe electrical receptacle, generally 1, has at least one outlet 15. The outlet 15 comprises a neutral slot 2, a hot slot 3 and a ground slot 4, all of which may have receptacle cover 5 secured to the fail safe electrical receptacle 1.

Figure 2:
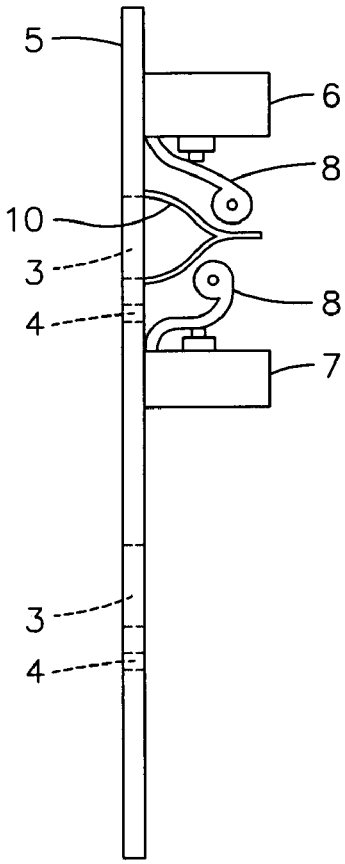
FIG. 2 is a right side view of the present invention installed on one outlet of the embodiment of FIG. 1.

In FIG. 2, a right side view of the present invention installed on one outlet of the embodiment of FIG. 1 is shown. A normally open switch 6 is preferably located behind the receptacle cover 5 above the hot slot 3. A normally closed switch 7 is preferably located behind the receptacle cover 5 below the hot slot 3. Hot side switch levers 8 are attached to the switches 6 and 7 and are positioned behind the hot slot 3. A hot side contact arm 10 assists the proper positioning of a standard electrical plug.

Figure 3:
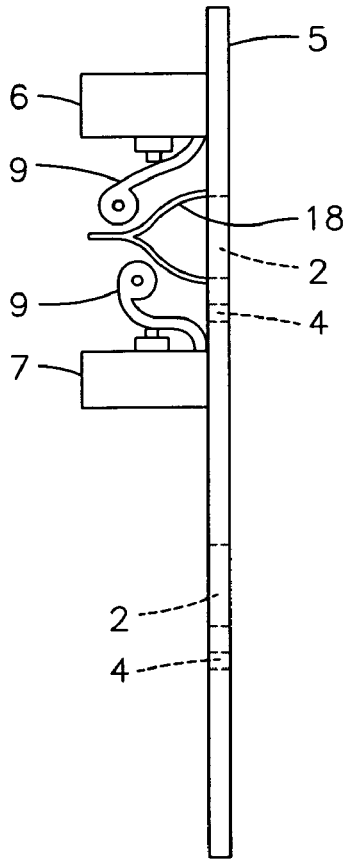
FIG. 3 is a left side view of the present invention installed on one outlet of the embodiment of FIG. 1.

In FIG. 3, a left side view of the present invention installed on one outlet of the embodiment of FIG. 1 is shown. A normally open switch 6 is preferably located behind the receptacle cover 5 above the neutral slot 2. A normally closed switch 7 is preferably located behind the receptacle cover 5 below the neutral slot 2. Neutral side switch levers 9 are attached to the switches 6 and 7 and are positioned behind the neutral slot 2. A neutral side contact arm 18 assists the proper positioning of a standard electrical plug.

Figure 4:
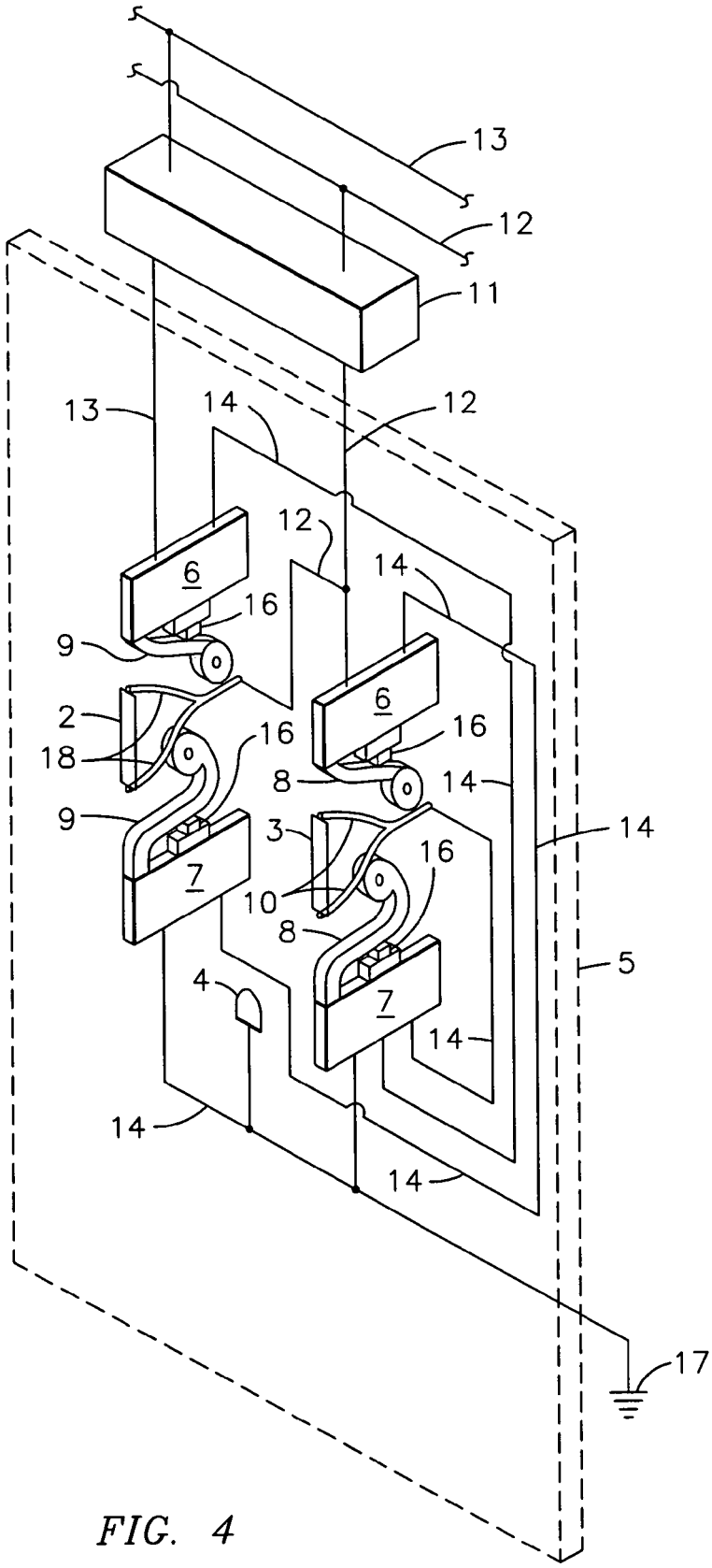
FIG. 4 is a cut-away perspective view of the wiring of the embodiment of FIGS. 2 and 3.

Finally, in FIG. 4, a cut-away perspective view of the wiring of the embodiment of FIGS. 2 and 3 is shown. The present invention is used in conjunction with a breaker 11, which will be a modified breaker with a different sensing coil than a GFCI breaker in a remote circuit breaker panel. Preferably, the breaker 11 uses a sensing coil that trips the breaker 11 on contact between neutral and ground wires on either: 1) a 120 volt, 15 amp circuit only with contact of 8 ohms or less or 2) a 120 volt, 20 amp circuit only with contact of 6 ohms or less.

The breaker 11 has hot wiring 13 and neutral wiring 12. The hot wiring 13 runs through the breaker 11 and into the normally open switch 6 of the neutral slot 2. The neutral wiring 12 runs through the breaker 11 and into the normally open switch 6 of the hot slot 3. The neutral wiring 12 also runs from the breaker 11 to the neutral side contact arms 18 of the neutral slot 2.

Grounded wiring 14 runs from the normally open switch 6 of the neutral slot 2 to the normally closed switch 7 of the hot slot 3. Grounded wiring 14 also electrically connects the normally open switch 6 of the hot slot 3 to the normally closed switch 7 of the neutral slot 2; the normally closed switch 7 of the hot slot 3 to an ground 17; the normally closed switch 7 of the neutral slot 2 to the ground 17 and the ground slot 4 to the ground 17. Grounded wiring 14 runs to the hot side contact arms 10 of the hot slot 3. Activators 16 are located on each of the switches 6 and 7.

Because of these electrical interconnections, all four switch levers 8 and 9 on both slots 2 and 3 must be fully depressed in order to complete a full circuit, thereby providing power to the outlet. If an object, such as a screwdriver, is inserted into any one of the slots 2 or 3, the screwdriver would first make contact with the switch levers 9 or 8, respectively. If either of the switch levers 9 or 8 presses the respective activator 16 on the normally closed switches 7, no power will be emitted from the slot 3 because these switches are normally closed.

If a screwdriver makes contact with the switch levers 9 or 8 and either of the levers 9 or 8 presses the activator 16 on the normally open switch 6, then the circuit between the hot slot 2 and the ground 17 or the circuit between the neutral slot 3 and the ground 17 is completed and the breaker 11 is tripped. Because the breaker 11 is tripped, a parent or other adult is placed on notice that someone has inserted a foreign object into an outlet and must reset the breaker 11 in order to provide power to all receptacles in the home. Preferably, the breaker 11 is a modified GFCI breaker so that if two identically sized objects are inserted into the slots 2 and 3 at the same time, for instance tweezers, the breaker 11 trips because a direct connection is made between both the neutral contact arms 18 and the hot side contact arms 10, which are grounded, of the slots 2 and 3. In addition, two of the switches on the neutral side 6 and on the hot side 7 are preferably rated for 15 amps. Further, although not shown in the drawings, the present invention may also use internal sensing coils so as to trip the individual breakers located on receptacles as well. The switch levers 8 and 9 must be non-conductive, either by being made of nonconductive material (e.g., plastic or rubber) or insulated with material to make them nonconductive, such as plastic, rubber, etc. Finally, although roller-type switch levers 8 and 9 are shown, other types of contact arms may be used.

Because two of the activators on the normally closed switches 7 and two of the activators on the normally open switches 6 must be depressed sequentially, only by the insertion of a standard electrical plug is the circuitry of the fail safe electrical receptacle completed in order to provide power to the electrical appliance. This is due to standard electrical plugs having one prong slightly larger than the other, therefore making it difficult to duplicate the identical sizing of the electrical plug.

Therefore, given any circumstance wherein an object which is not a standard electrical plug is inserted into the fail safe electrical receptacle of the present invention, a person will not become shocked.

The use of the present invention will provide a one hundred percent child safe power receptacle that not only prevents children from getting shocked, but also gives notice to adults that someone has inserted a foreign object into an outlet.

It is to be understood that while a certain form of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A fail safe electrical receptacle comprising:

at least one neutral slot and at least one hot slot;

a first normally open switch located adjacent to said at least one neutral slot;

said first normally open switch electrically connected to a neutral wire;

a second normally open switch located adjacent to said at least one hot slot;

said second normally open switch electrically connected to a hot wire;

a first normally closed switch located adjacent said at least one neutral slot;

said first normally closed switch connected to a ground;

a second normally closed switch located adjacent said at least one hot slot;

said second normally closed switch connected to said ground;

said first normally open switch connected to said second normally closed switch;

said second normally open switch connected to said first normally closed switch; and said second normally closed switch connected to said ground.

2. The fail safe electrical receptacle of claim 1 wherein:

said hot wire and said neutral wire are connected to a breaker.

3. The fail safe electrical receptacle of claim 1 wherein:

said first normally open switch has at least one switch lever;

said second normally open switch has at least one switch lever;

said first normally closed switch has at least one switch lever; and said second normally closed switch has at least one switch lever.

4. The fail safe electrical receptacle of claim 3 wherein:

said first normally open switch has an activator;

said second normally open switch has an activator;

said first normally closed switch has an activator; and said second normally closed switch has an activator.

5. The fail safe electrical receptacle of claim 1 further comprising:

a ground slot connected to the ground.

6. The fail safe electrical receptacle of claim 3 wherein:

said at least one switch lever on said first normally open switch is a roller-type;

said at least one switch lever on said second normally open switch is a roller-type;

said at least one switch lever on said first normally closed switch is a roller-type; and said at least one switch lever on said second normally closed switch is a roller-type.

7. The fail safe electrical receptacle of claim 1 further comprising:

a receptacle cover.

8. A fail safe electrical receptacle comprising:

a receptacle cover having at least one neutral slot, at least one hot slot and a ground slot;

a first normally open switch located adjacent to said at least one neutral slot;

said first normally open switch electrically connected to a neutral wire;

said first normally open switch having roller-type switch levers;

said first normally open switch having an activator;

a second normally open switch located adjacent to said at least one hot slot;

said second normally open switch electrically connected to a hot wire;

said second normally open switch having roller-type switch levers;

said second normally open switch having an activator;

said hot wire and said neutral wire are connected to a breaker;

said breaker is a ground fault circuit interrupter;

a first normally closed switch located adjacent said at least one neutral slot;

said first normally closed switch connected to a ground;

said first normally closed switch having roller-type switch levers;

said first normally closed switch having an activator;

a second normally closed switch located adjacent said at least on hot slot;

said second normally closed switch connected to said ground;

said second normally closed switch having roller-type switch levers;

said second normally closed switch having an activator;

said first normally open switch connected to said second normally closed switch;

said second normally open switch connected to said first normally closed switch;

said second normally closed switch connected to said ground; and a ground slot connected to said ground.

9. A method of operating a fail safe electrical receptacle comprising at least one neutral slot and at least one hot slot; a first normally open switch located adjacent to said at least one neutral slot; said first normally open switch electrically connected to a neutral wire; a second normally open switch located adjacent to said at least one hot slot; said second normally open switch electrically connected to a hot wire; a first normally closed switch located adjacent said at least one neutral slot; said first normally closed switch connected to a ground; a second normally closed switch located adjacent said at least one hot slot; said second normally closed switch connected to said ground; said first normally open switch connected to said second normally closed switch; said second normally open switch connected to said first normally closed switch; and said second normally closed switch connected to said ground, said method comprising the step of:

inserting an object into at least one slot.

10. The method of claim 9 wherein:

said object is a standard electrical plug.

* * * * *